US005575117A

United States Patent [19]

Soltis et al.

[11] Patent Number: 5,575,117

[45] Date of Patent: Nov. 19, 1996

[54] BREAK-IN RESISTANT WOOD PANEL DOOR

[75] Inventors: Lawrence A. Soltis, Mt. Horeb; Robert J. Ross, Madison, both of Wis.; William W. von Segen, Portland, Oreg.

[73] Assignee: The United States of America as represented by the Secretary of Agriculture, Washington, D.C.

[21] Appl. No.: 576,998

[22] Filed: Dec. 26, 1995

Related U.S. Application Data

[63] Continuation-in-part of Ser. No. 204,114, Mar. 1, 1994, Pat. No. 5,501,054.

[51] Int. Cl.[6] ..... E06B 1/04

[52] U.S. Cl. ..... 49/460; 49/503; 49/504; 52/514; 292/346

[58] Field of Search ..... 49/462, 460, 503, 49/504, 501; 52/514, DIG. 7; 292/346; 70/418, 416

[56] References Cited

U.S. PATENT DOCUMENTS

| | | | |
|---|---|---|---|
| 3,894,357 | 7/1975 | Stanfield . | |
| 3,918,207 | 11/1975 | Aliotta | 49/462 |
| 4,080,764 | 3/1978 | Stowik et al. . | |
| 4,120,749 | 10/1978 | Humphrey . | |
| 4,180,944 | 1/1980 | Stowik et al. . | |
| 4,271,649 | 6/1981 | Belanger | 49/503 X |
| 4,432,179 | 2/1984 | Bachmann . | |
| 4,483,267 | 11/1984 | Seemann, III . | |
| 4,770,452 | 9/1988 | Petree, Jr. | 49/504 X |
| 4,832,388 | 5/1989 | Lozano . | |
| 4,854,622 | 8/1989 | Lozano . | |
| 4,858,384 | 8/1989 | Blankenship | 49/460 |
| 4,995,213 | 2/1991 | Bezubic . | |
| 5,072,547 | 12/1991 | DiFazio . | |
| 5,076,626 | 12/1991 | Tiddy et al. | 49/460 X |
| 5,154,461 | 10/1992 | Prescott et al. | 49/503 X |
| 5,326,410 | 7/1994 | Boyles | 52/514 X |
| 5,406,768 | 4/1995 | Giuseppe et al. . | |

*Primary Examiner*—Philip C. Kannan
*Attorney, Agent, or Firm*—Janet I. Stockhausen; M. Howard Silverstein; John D. Fado

[57] ABSTRACT

A wooden panel door reinforced against attempted break-in contains layers of fiberglass mat and decorative wooden facing strip bonded to the doorjamb and stiles. The stiles and doorjamb are constructed from wood with grain that runs primarily in a single direction, and reinforcing these stiles and doorjambs against impact can be achieved by bonding to them a fiberglass mat, which contains fibers running in transverse directions. The fiberglass mat is in turn covered by a decorative wooden facing strip layer.

11 Claims, 2 Drawing Sheets

BREAK-IN RESISTANT WOOD PANEL DOOR

This application is a continuation-in-part of U.S. application Ser. No. 08/204,114 filed Mar. 1, 1994 now U.S. Pat. No. 5,501,054.

FIELD OF THE INVENTION

The invention relates generally to wooden doors, and in particular to wooden panel doors having wooden stiles and rails framing one or more panels.

BACKGROUND OF THE INVENTION

The wooden panel door derives its name from the fact that it is constructed of separate panels held between vertical stiles and horizontal rails. The stiles and rails are generally milled separately and assembled about the panels to produce a sturdy but elegant door amenable to a variety of finishes including those in which the natural wood is exposed. The use of wood provides good thermal insulation and the broad areas of the stiles allow flexible placement of the lock set and hinges at the construction site with standard woodworking tools.

Nevertheless, the panel door is not well adapted to applications where security is important. Even with a reasonable thickness of lumber and despite the availability of numerous lumber types, a panel door is still readily breached by strong impact which may break the lock set from the lock stile and/or the strike plate from its opposing jamb. Although this may be remedied somewhat by the use of large protective escutcheons, these are not always effective and, by requiring insertion of additional mounting screws into the door stile, escutcheons may in fact further weaken the stile itself. Escutcheons invariably make the door less attractive.

Accordingly, for security sensitive applications, it is typical to use steel doors. Although these doors may have an embossed surface reminiscent of a panel door, they are generally less attractive and more expensive alternatives to a wooden panel door.

SUMMARY OF THE INVENTION

The present invention recognizes that the weakest point of a wooden panel door is in the orientation of the grain of the stiles with respect to the forces likely to be imposed on the door in an attempted break-in. Specifically, the forces are perpendicular to the grain, tending to separate the individual wood fibers from one another rather than to break or bend the fibers themselves. Accordingly, the present inventors have recognized that a relatively small amount of high tensile reinforcing material counteracting the ease with which fibers may be separated can substantially increase the strength of a wooden panel door against forces incident in an attempted break-in without unduly increasing the cost of the door or diminishing its aesthetic qualities.

In particular, the present invention provides a wood panel door for use with a lock set where the door comprises spaced apart longitudinally extending butt and lock stiles, joined at their ends by transversely extending top and bottom rails to contain at least one panel between the stiles and rails. The lock stile is composed of wood having longitudinally extending grain, with a fiber mat bonded to at least one of the faces of the lock stile near the location of the lock set. The fiber mat is oriented to provide transverse tensile restraint on the grain of the lock stile.

Thus, it is one object of the invention to precisely augment the strength of the lock stile in its weakest direction and thus to substantially increase the resistance of the lock stile to splitting under the forces imposed on the lock stile by the lock set under impact.

The door may also include a decorative wooden stile facing strip, where the fiber mat is sandwiched between the lock stile and the wooden stile facing strip.

Thus, it is another object of the invention to substantially increase the strength of a wooden panel door without detracting from its aesthetic qualities. With the mat sandwiched between the stile and strip, the door still appears to be constructed entirely of wood.

It is a further object of the invention to preserve the natural machinability of a wooden panel door with this added reinforcement. The wooden stile facing strip provides a purchase for hole saws and augers used for installation of a lock set and permits the face of the door to be sanded, stained, and finished in a manner indistinguishable from a conventional wooden panel door.

The fiber mat is preferably fiberglass compressed between the wooden stile facing strip and the wooden stile, with the strip and stile deformed under pressure about the mat and enclosing it, the strip and stile joined at a nearly invisible seam, with none of the fiber mat visible. The high tensile strength of fiberglass permits the amount of mat material to be minimized, preserving the essential wooden quality of the door.

The fiber mat may be placed on the inner surface of the stile to resist an inward buckling of the stile under impact to the lock set from the outside.

Thus, it is another object of the invention to minimize the need for reinforcing material by careful placement of the reinforcing material.

Similar mats may be used to reinforce the doorjamb and stiles at the hinge points and the doorjamb near the location of the strike plate. In both these cases, a wooden facing strip is thicker than the hinge leaves or strike plate, permitting the recessing of the hinge leaves or strike plate per conventional practice without the damaging of the fiber mat.

Thus, it is another object of the invention to improve the resistance to break-in of a wooden panel door and a combined jamb assembly by selectively increasing the strength of all the points of attachment of the door to the jamb assembly.

The foregoing and other objects and advantages of the invention will appear from the following description. In the description, reference is made to the accompanying drawings which form a part hereof and in which there is shown by way of illustration, a preferred embodiment of the invention. For clarity, two simple examples of a control system are provided. Such embodiments do not necessarily represent the full scope of the invention as claimed.

DETAILED DESCRIPTION OF THE PREFERRED EMBODIMENT

Figure 1:
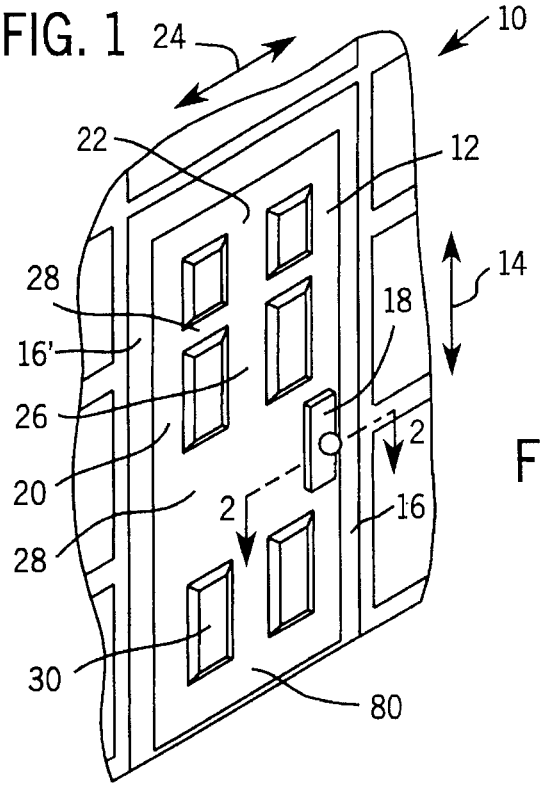
FIG. 1 is a perspective view from the outside of a wooden six-panel door showing the various components of such a door.

Referring now to FIG. 1, a wooden six-panel door 10 includes a vertically extending lock stile 12 having grain running in a longitudinal direction 14 and forming a vertical edge of the door 10 adjacent to a doorjamb 16. The lock stile 12 supports a lock set 18, containing a bolt (not shown in FIG. 1) which engages a strike plate (also not shown in FIG. 1) contained within the jamb 16. The vertical edge of the door 10 opposite to lock stile 12 is formed by a butt stile 20 connected by one or more hinges (not shown in FIG. 1) to an adjacent jamb 16. The butt stile 20 and lock stile 12 are joined at their upper ends by a top rail 22, which forms the top edge of the door 10 and has grain running in a transverse direction 24. Similarly, the butt stile 20 and lock stile 12 are joined at their bottom ends by a bottom rail 80, which forms the bottom edge of the door and has grain running in a transverse direction 24. Center stile 26 and center rails 28 divide the face of the door 10 into six rectangular areas holding panels 30.

Figure 2:
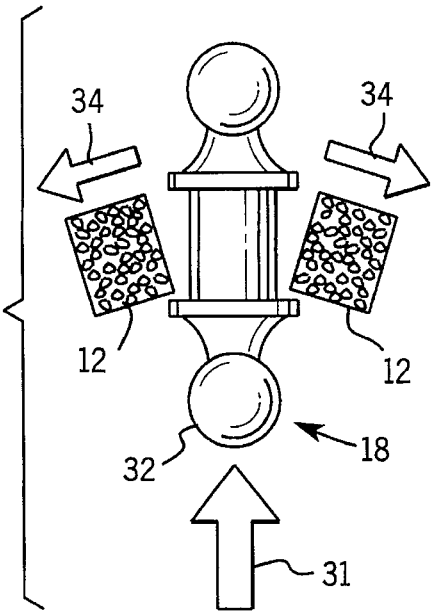
FIG. 2 is a schematicized cross-section along lines 2—2 of FIG. 1 showing an impact on the door knob of the door of FIG. 1 such as causes a transverse separation of the grain of the lock stile of the door.

Referring now to FIG. 2, inward impact force 31 on the door knob 32 causes a transverse tensile force 34 generally perpendicular to the longitudinal direction 14 of the grain of the lock stile 12. The internal composition of wood may be likened to a set of strong tubes which run along the grain and weakly adhere to each other. Accordingly, forces perpendicular to the grain, which are resisted only by the adherence of the tubes to one another, may easily split the wood. Accordingly, even moderate transverse forces 34 may cause a shattering of the lock stile 12 brought about by a separation of the grain.

Figure 3:
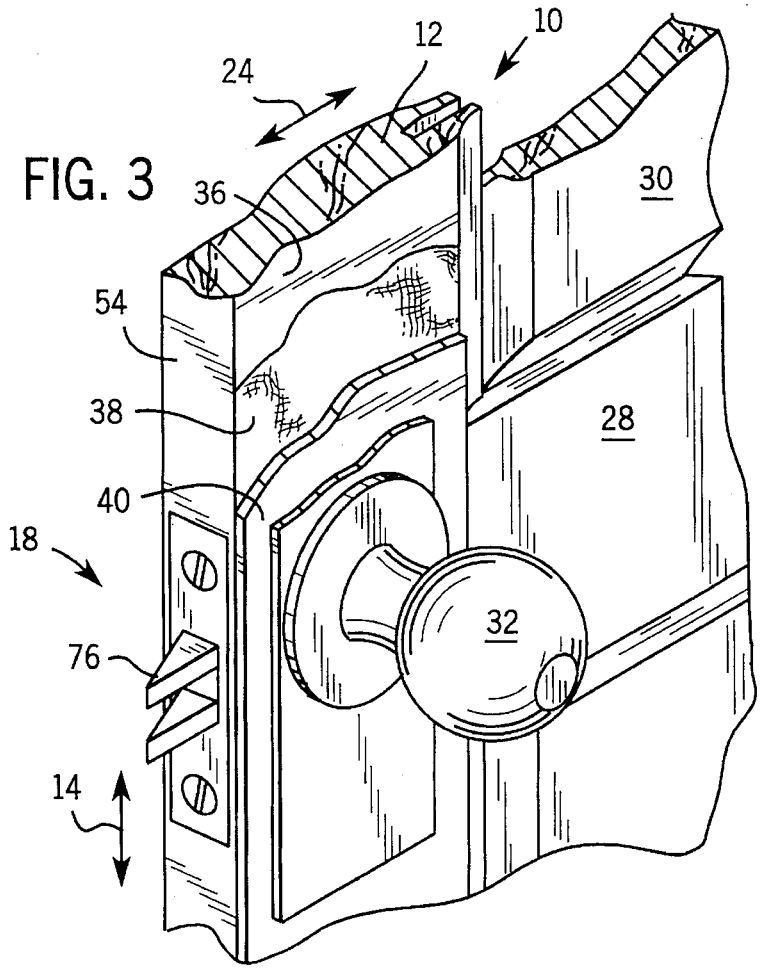
FIG. 3 is a perspective detailed view of the door of FIG. 1 from the inside in progressive cut-away, showing the placement of a fiber mat between a stile facing strip and the lock stile to prevent fiber separation under impact.

Referring now to FIG. 3, in the present invention the inner face 36 of the lock stile 12 in the vicinity of the lock set 18 has bonded to it a loosely woven fiber mat 38 having a high tensile strength in the transverse direction 24. As shown, the strands of the fiber mat 38 run generally diagonal to the transverse direction 24 and longitudinal direction 14, but have nevertheless a significant component in the transverse direction 24. Alternatively, a fiber mat 38 may be used which has strands predominantly in only one direction, the fiber mat 38 being laid on the lock stile such that the strands of the mat 38 are in the transverse direction 24.

In the preferred embodiment, the fiber mat 38 is made of fiberglass, and is bonded to the lock stile using a bonding agent such as epoxy resin or a phenolic type resin (not shown). Commercial suppliers of fiberglass mats 38 and resin include: Clark-Schwebel, 3M, and Johns-Mannsville. Any commercially available resin may be used to apply the fiberglass mat 38 to the lock stile 12. Boat-building resins which are specifically designed for bonding fiberglass to a wooden substrate, such as those advertised under the trademark WEST SYSTEM® and manufactured by Gougeon Brothers, Inc., are preferred. The precise epoxy resin (base and hardener) used will be determined by those skilled in the art.

Bonded in a layer on top of the fiber mat 38 is a decorative wooden-stile facing strip 40 which covers the fiber mat 38, sandwiching mat 38 between the face 36 of a lock stile 12 and strip 40. The stile facing strip 40 may be a relatively thin veneer, having grain oriented in the longitudinal direction 14 to match that of the underlying lock stile 12 for the sake of appearances. In construction, the lock stile facing strip 40 and lock stile 12 are compressed together during curing of the bonding material holding the fiber mat 38 to the face 36 of the lock stile 12; this allows the wood of the strip 40 and stile 12 to deform about and enclose the fiber mat 38, the strip 40 and stile 12 joining at a nearly invisible seam, with none of the fiber mat 38 remaining visible. The stile facing strip 40 is also constructed of the same material as the lock stile 12 so as to accept finishes such as stains in the same way as the lock stile 12 and the rails 28 and panels 30. In another embodiment, the fiber mat 38 and facing strip 40 are bonded as layers to a lumber stock, which is then milled to produce the stiles or other door components.

Figure 4:
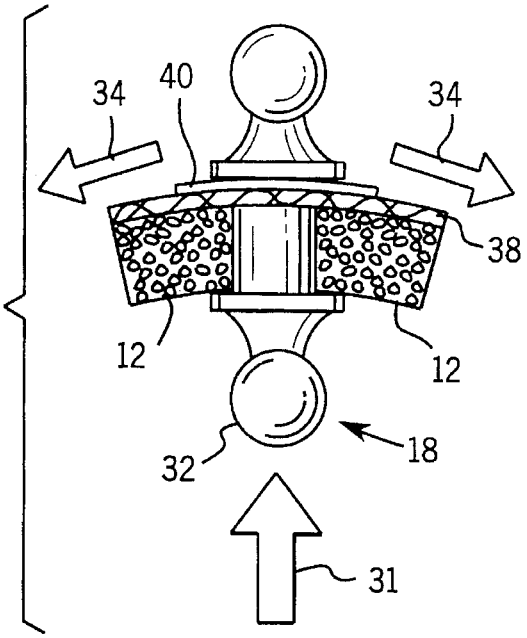
FIG. 4 is a figure similar to that of FIG. 2 showing the resistance of the transverse forces by the fiber mat during impact against the door knob such as may occur during a break-in attempt.

Referring to FIG. 4, an impact force 31 on the door knob 32 produces tensile forces 34 which are resisted by the fiber mat 38 which prevents the grains from separating in the lock stile 12. Although the fiber mat 38 and strip 40 are shown positioned on the interior of the door, mat 38 and strip 40 may alternatively be placed on only the exterior of the door, or it may be desirable to place both fiber mat 38 and strip 40 on both the interior and exterior of the door for added strength.

Referring again to FIG. 3, the lock set 18 may be installed in the panel door 10 by cutting the necessary holes with conventional wood-working tools such as a hole saw and/or auger. The fiber mat 38 may be easily cut by such tools when bonded to the lock stile 12.

Figure 5:
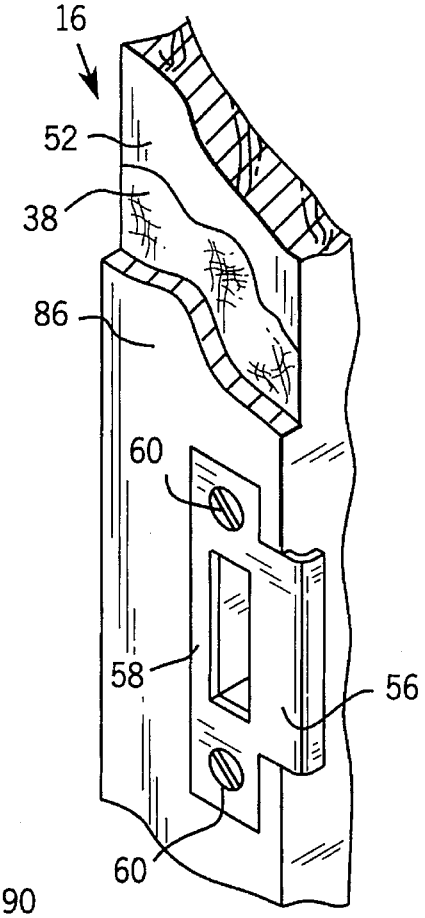
FIG. 5 is a detailed perspective view of a strike plate inserted in a jamb used with the door of FIG. 1 in progressive cut-away showing the use of a fiber mat to improve the resistance of the jamb to splitting under impact against the door such as would transfer force to the strike plate through a bolt of the lock set.

Referring now to FIGS. 3 and 5, the doorjamb, shown generally at 16, has a face 52 which abuts the adjacent face 54 of lock stile 12 when door 10 is closed. The grain of doorjamb 16 runs in the longitudinal direction 14. Fiber mat 38 and wooden edging strip 86 may be bonded in layers to face 52, such that fiber mat 38 is sandwiched between strip 86 and face 52. Strike plate 56 is positioned to receive the latch bolt 76 of lock set 18, and the strike plate 56 is recessed into the doorjamb 16 in a manner known to the art to a depth equal to the thickness of strike plate 56. In this embodiment, the fiber mat 38 has high tensile strength in transverse directions to longitudinal direction 14, and the use of the fiber mat 38 improves the resistance of the doorjamb 16 to splitting under impact against the door 10, the force of which impact would transfer to the doorjamb 16 through bolt 76 of the lock set 18.

Figure 6:
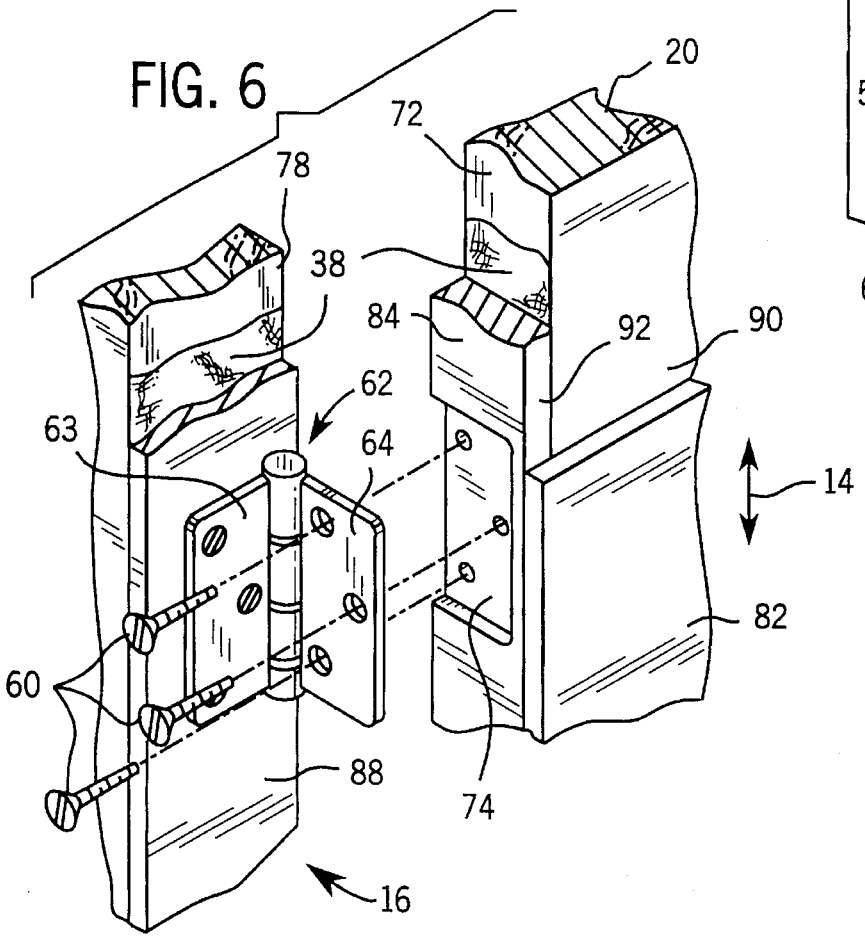
FIG. 6 is a fragmentary perspective view of a portion of the butt stile of the door and opposing doorjamb of FIG. 1 in progressive cut-away showing the placement of a fiber mat between a wooden stile edging strip and the edge of the butt stile, the edging strip to receive a recessed hinge shown in exploded view.

Referring now to FIG. 6, the butt stile 20 has a face 72 which is adjacent to face 78 of doorjamb 16 when door 10 is closed. Butt stile 20 and doorjamb 16 each have a grain running in longitudinal direction 14. Fiber mat 38 and edging strip 84 may be bonded in layers to face 72, such that fiber mat 38 is sandwiched between strip 84 and face 72. Similarly, fiber mat 38 and wooden edging strip 88 may be bonded in layers to face 78, such that fiber mat 38 is sandwiched between strip 88 and face 78. Hinge 62 has two leaves 63, 64 which are attached by screws 60 to faces 72, 78, respectively. Leaves 63, 64 are recessed into faces 72, 78 to a depth equal to the thickness of leaves 63, 64, in a manner known to the art. Strips 84, 88 may be of thickness greater than that of hinge leaf 64, and standard woodworking tools may be used to create a recess 74 in strips 84, 88 shaped to accommodate leaf 64. In this embodiment, the fiber mat 38 has high tensile strength in transverse directions to longitudinal direction 14, and thus use of the fiber mat 38 improves the resistance of doorjamb 16 and butt stile 20 to splitting under impact against the door 10. The face 90 of butt stile 20, which is the face facing the exterior of the building when the door 10 is closed, may also be covered by wooden facing strip 82, which is bonded in a layer to butt stile 20. Facing strip 82 overlaps and conceals the side edge 92 of edging strip 84 such that no seam between facing strip 82 and edging strip 84 are visible.

Portions of the butt stile 20, the lock stile 12 and the doorjamb 16 may be separately, collectively or in any combination reinforced with layers of fiber mat 38.

Many other modifications and variations of the preferred embodiment which will still be within the spirit and scope of the invention will be apparent to those with ordinary skill in the art. In order to apprise the public of the various embodiments that may fall within the scope of the invention, the following claims are made:

We claim:

1. A wooden panel door for use with a lock set, the door comprising spaced apart longitudinally extending butt and lock stiles joined at their ends by transversely extending top and bottom rails to contain at least one panel between the stiles and rails, wherein the lock stile is composed of wood having longitudinally extending grain and wherein the lock stile has bonded to at least one face proximate to a location of the lock set, a fiber mat oriented to provide transverse tensile restraint on the grain of the lock stile, including additionally a wooden stile facing strip and wherein the fiber mat is sandwiched between the lock stile and the wooden stile facing strip.

2. The panel door as recited in claim 1 wherein the wooden stile facing strip and lock stile deform inward against the fiber mat to abut without visible seam.

3. The panel door as recited in claim 1 wherein the fiber mat is woven fiberglass.

4. The panel door as recited in claim 1 wherein the face of the lock stile is the face that would be facing an interior of a building when the door is installed.

5. The panel door as recited in claim 1 wherein the fiber mat is bonded to both the face of the lock stile facing the exterior of a building and the face of the lock stile facing the interior of the building when the door is installed.

6. A wooden panel door for use with hinges having hinge leaves recessed to the depth equal to the thickness of a hinge leaf, the door comprising spaced apart longitudinally extending butt and lock stiles joined at their ends by transversely extending top and bottom rails to contain at least one panel between the stiles and rails, wherein the butt stile is composed of wood having longitudinally extending grain and wherein the butt stile has bonded to an edge receiving the recessed hinge leaf, a fiber mat oriented to provide transverse tensile restraint on the grain of the lock stile, the butt stile further having a wooden stile edging strip thicker than the leaf thickness and wherein the fiber mat is sandwiched between the lock stile and the wooden stile edging strip.

7. The panel door as recited in claim 6 wherein the wooden stile edging strip and butt stile deform around and enclose the fiber mat, the strip and stile abutting without visible seam, with none of the fiber mat visible.

8. The panel door as recited in claim 6 including additionally a wooden stile facing strip and wherein a seam between the stile edging strip and the butt stile is covered by the wooden stile facing strip.

9. The panel door as recited in claim 6 wherein the fiber mat is woven fiberglass.

10. A doorjamb assembly for use with a door having a bolt, the doorjamb comprising spaced apart longitudinally extending jamb members joined at their top ends by a transversely extending lintel to frame a doorjamb, the jamb members extending longitudinally by the height of the door and composed of wood having longitudinally extending grain and wherein at least one jamb member has bonded to at least one face proximate to a location of a strike plate for receiving the bolt, a fiber mat oriented to provide transverse tensile restraint on the grain of the jamb member, the jamb member further having a wooden jamb facing strip and wherein the fiber mat is sandwiched between the jamb member and the wooden jamb facing strip.

11. The doorjamb assembly as recited in claim 10 wherein the fiber mat is woven fiberglass.

* * * * *